United States Patent [19]

Arnone

[11] Patent Number: 5,072,839

[45] Date of Patent: Dec. 17, 1991

[54] DISPLAY STAND ASSEMBLY

[75] Inventor: A. Jeanne Arnone, Rockford, Ill.

[73] Assignee: Myco, Inc., Rockford, Ill.

[21] Appl. No.: 619,136

[22] Filed: Nov. 28, 1990

[51] Int. Cl.[5] ..... A47F 5/00

[52] U.S. Cl. ..... 211/187; 211/90; 211/181; 108/144; 108/108

[58] Field of Search ..... 211/181, 187, 90, 106, 211/193; 108/144, 107, 108

[56] References Cited

U.S. PATENT DOCUMENTS

| | | | |
|---|---|---|---|
| 3,701,325 | 10/1972 | Fenwick | 108/108 X |
| 3,965,826 | 6/1976 | Markham | 211/187 X |
| 3,993,002 | 11/1976 | Stroh | 211/90 X |
| 4,159,775 | 7/1979 | Young | 211/187 X |
| 4,623,065 | 11/1986 | Cooper | 211/187 |
| 4,776,472 | 10/1988 | Rosen | 211/187 |

*Primary Examiner*—Robert W. Gibson, Jr.
*Attorney, Agent, or Firm*—Willian Brinks Olds Hofer Gilson & Lione

[57] ABSTRACT

A display stand assembly is provided which includes elongate upright support members and a plurality of horizontally disposed, vertically spaced product-support units removably mounted on the support members. Any unit may be readily assembled on or disassembled independently from the support members without disturbing adjoining units disposed above or below same.

11 Claims, 2 Drawing Sheets

DISPLAY STAND ASSEMBLY

BACKGROUND OF THE INVENTION

In the retail merchandising of various products it is oftentimes desirable to have the products displayed on shelves, racks or rods whereby the customer may closely inspect, feel and select the individual products. In supermarkets, hardware stores, drugstores and department stores, it is a common practice for the customer to serve himself or herself and carry or transport by cart the selected products to a checkout counter or cashier. Frequently, at such locations there may be numerous customers waiting in line to be served. Thus, various items such as magazines, candy, batteries, various sundry articles and special sale items are commonly displayed in close proximity to the checkout counter, or cashier, resulting in routine or impulse purchases by the waiting customers. It is important that such items be displayed in an attractive, stable manner and in such a way that the selected items be conveniently and readily removed from the display without disturbing other items supported by the display. In addition to being located in proximity to the checkout counter or cashier, special sale or feature items are oftentimes displayed in or proximate the aisles where the customers are accustomed to walk or stroll while shopping.

The type, size or shape of the products or articles displayed may vary over a wide range and the location of the display may be changed frequently. Where the display includes shelves which are vertically spaced, it is frequently necessary to change the vertical spacing of selected shelves to better accommodate particular products.

Heretofore, the changing of such selected shelves has been an awkward and frustrating manipulation, sometimes requiring an inordinate amount of manual labor. To disengage the selected shelves from a vertical support (e.g. wall bracket or vertical post-like members), oftentimes required that a selected shelf be tilted upwardly a substantial amount relative to the bracket or post-like member to effect the desired disengagement from the support members. The same manual manipulation, but in reverse, was required to effect the desired engagement. Thus, because of the required tilting of the selected shelf, interference from the adjoining shelves frequently occurred. Furthermore, in some instances, adjusting such shelves required the utilization of special tools and the cooperative effort of one or more additional persons. Prior display stand assembly often embodied an inordinate number of components some of which were bulky, heavy and unattractive and susceptible to being lost or mislaid.

SUMMARY OF THE INVENTION

Thus, an improved display stand assembly has been provided which avoids all of the aforementioned shortcomings besetting assemblies of this general type.

The improved display stand assembly is of simple, yet sturdy, construction, has a minimum number of components and is readily assembled or disassembled and relocated when desired.

The improved display stand assembly may be readily set up by a single person without the need for special tools. Further and additional advantages of the improved display stand assembly will become apparent from the description, accompanying drawings and appended claims.

In accordance with one embodiment of the invention an improved display stand assembly is provided which includes a pair of upright support members arranged in horizontally spaced, substantially parallel relation. Spanning the distance between the pair of support members and mounted for selective vertical adjustment thereon are a plurality of product-support units. A corresponding exposed surface of each support member is provided with a plurality of slots arranged in a pair of parallel, upwardly extending rows. One row of slots is vertically offset with respect to the other row. Each slot includes an elongate, upright first section and a second section extending laterally from the lower end portion of the first section. Each second section has a distal end portion. The distal end portions of the slot in a row are disposed in vertical alignment.

Each product-support unit may be provided with a shelf-like section which projects outwardly from the corresponding exposed surfaces of the pair of support members. Projecting rearwardly from a peripheral segment of the shelf-like section are finger-like elements. Each element includes an inner portion extending from the peripheral segment and outer portion extending upwardly from the inner portion and spaced from the peripheral segment of the shelf-like section. The inner and outer portions are disposed in a substantially vertical plane. The first and second sections of each slot are dimensioned so that when the inner and outer portions of the finger-like element are in registry with the slot first section, the finger-like element can pass in a substantially horizontal direction through the slot when the product-support unit is engaging or disengaging the support members. When the unit is being assembled with the support members, the finger-like elements are positioned adjacent the exposed surfaces of the support members and in registration with the upright first sections of corresponding slots. The unit is then manually moved horizontally towards the exposed surfaces whereupon the outer portions of the finger-like elements simultaneously pass through the slot first section until they clear the concealed back or rear surfaces of the support members which are disposed opposite the exposed surfaces. When this occurs the inner portions of the elements are fully disposed within the slots and are aligned with the slot second sections. The unit is then laterally moved manually along the slot second sections until the accommodated inner portions of the elements reach the distal ends of the corresponding slots. The distal end of each slot is provided with suitable means (e.g., a slight recess) which restrains unintentional and undesirable shifting of the unit back to the slot first section. When the unit finger-like elements are shifted along the slot second sections and while the elements are disposed at the slot distal ends, the upright outer portions of the elements are in sliding engagement with the concealed back surfaces of the support members thereby effecting an interlocked relation between the product-support unit and the support members. Because the unit is cantilevered outwardly from the support members, the weight of the unit per se will maintain a continuous positive engagement between the outer portions of the finger-like elements and support member concealed surfaces.

DESCRIPTION

For a more complete understanding of the invention, reference is made to the drawings wherein.

Figure 3:
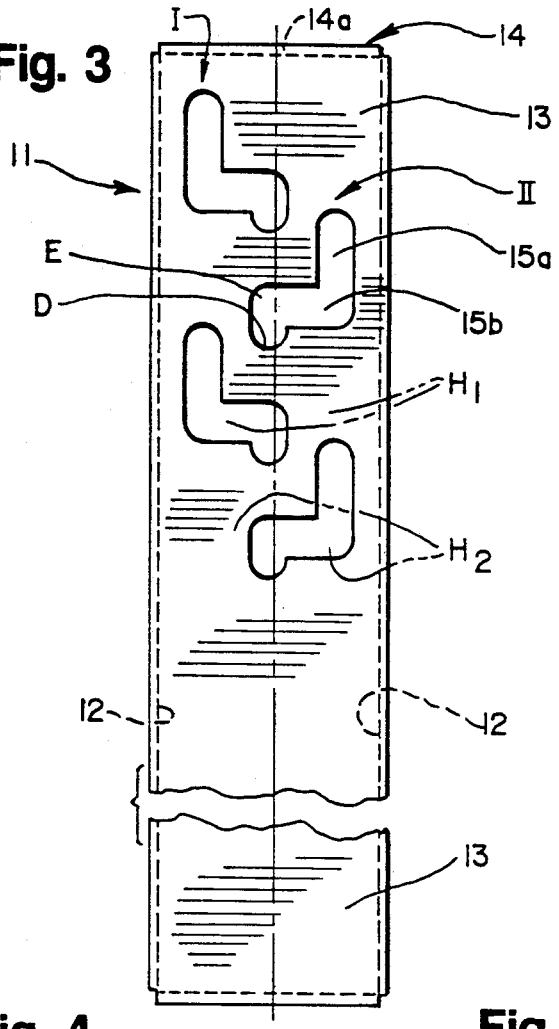
FIG. 3 is an enlarged, fragmentary, front elevational view of the slotted, exposed, upright surface of one of the support members shown in FIG. 1.
Figure 4:
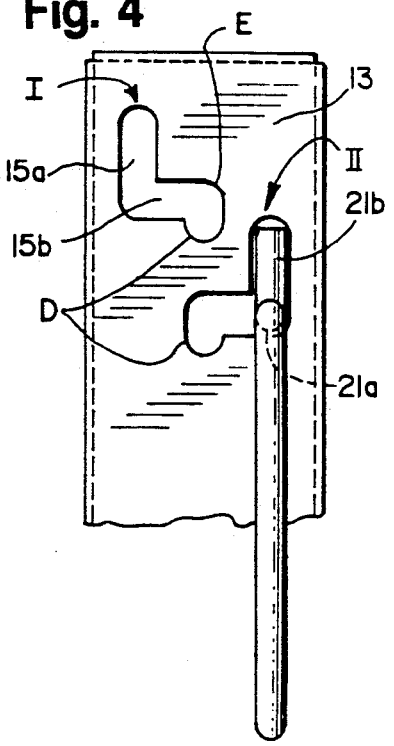
Figure 4A:
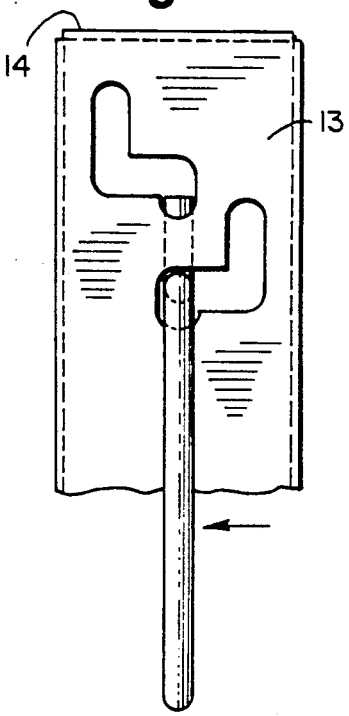
Figure 4B:
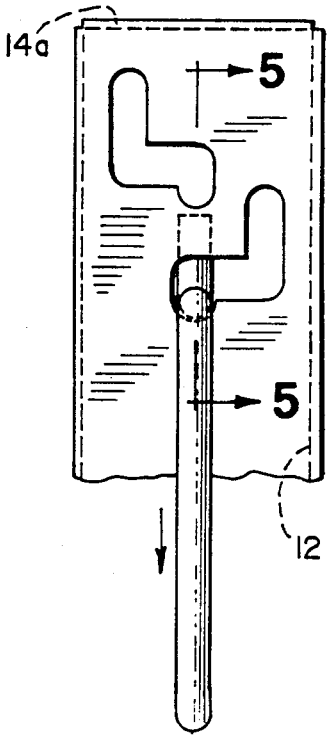

FIGS. 4, 4*a* and 4*b* are enlarged fragmentary front elevational views similar to FIG. 3 but showing, respectively, one finger-like element of a product-support unit in three successive stages of being assembled with the support member.

Figure 5:
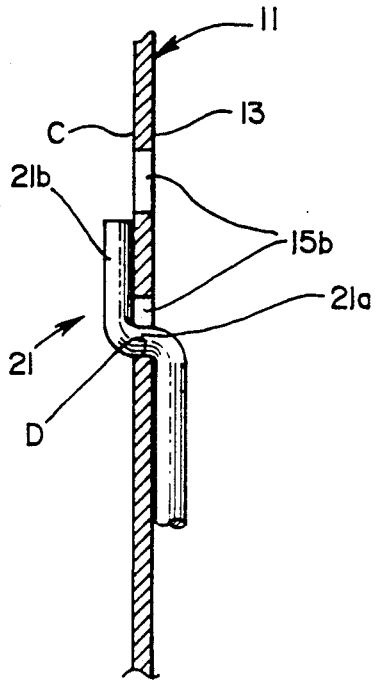

FIG. 5 is an enlarged, fragmentary sectional view taken along line 5—5 of FIG. 4*b*.

Figure 1:
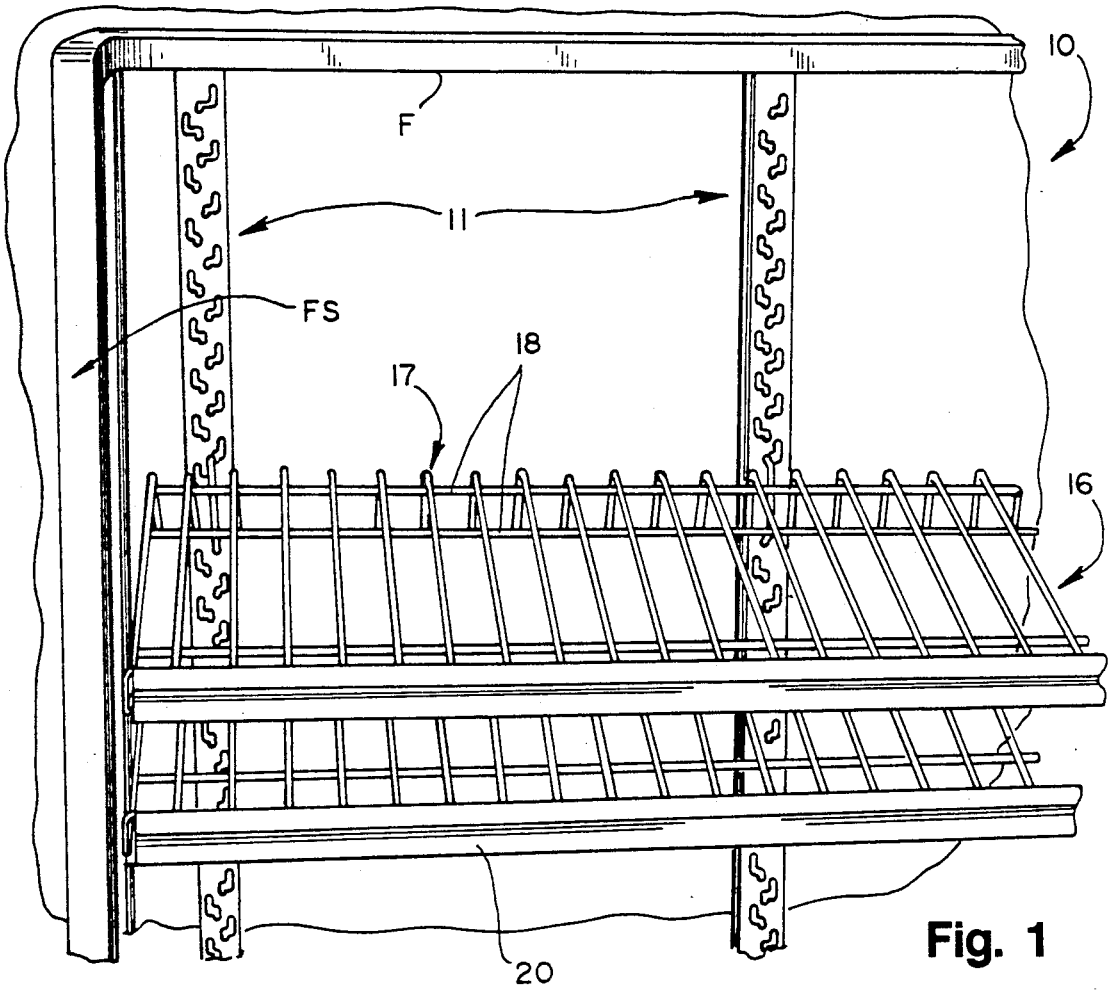
FIG. 1 is a fragmentary front view of one embodiment of the improved display stand assembly showing a plurality of vertically spaced product-support units mounted on upright support members.
Figure 2:
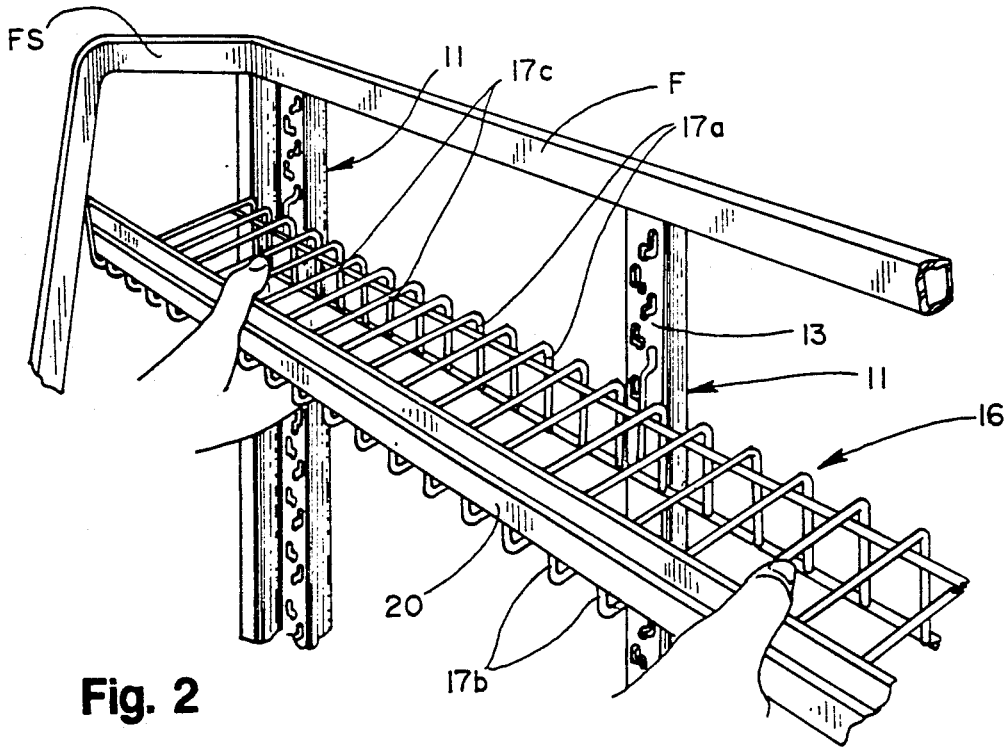
FIG. 2 is similar to FIG. 1, but showing the uppermost product-support unit being manually disassembled from the slotted upright support members.

Referring now to the drawings and more particularly to FIGS. 1 and 2, a preferred embodiment of the improved display stand assembly 10 is shown as a stand-alone structure. The assembly 10, as shown, includes a plurality of horizontally spaced, parallel upright post-like support members 11 which may be interconnected along top and/or bottom by transverse frame pieces F. Connected to the end portions of frame pieces F may be angularly disposed upright frame end section FS, only one of which is partially shown in FIGS. 1 and 2 which stabilize the assembly. In lieu of the end sections FS, transverse footings, not shown, may be secured to the lower ends of a predetermined number of upright support members 11. The frame end sections or the footings may, if desired, be secured by suitable fasteners to a floor.

Where the upright support members are mounted directly to a vertical wall, a plurality of suitable fasteners are utilized for each support member and are adapted to fixedly secure the support member to the adjacent wall.

Each support member preferably is a channel section having a pair of parallel side flanges 12 interconnected along one edge by an intermediate section 13. The flanges and intermediate section 13 are substantially coextensive and the upper and lower ends thereof may be interconnected by a transverse reinforcing piece 14, see FIG. 3. Each piece 14 may be provided with a suitable opening 14*a* to accommodate a suitable fastener for interconnecting the supporting member to a frame piece F.

As noted in FIG. 3, the intermediate section 13 of each support member 11 is provided with a plurality of slots 15, preferably arranged in a pair of longitudinally extending, parallel rows I and II. The rows are disposed in vertically offset relation.

Each slot 15 in a row includes a longitudinally extending upright first section 15*a* and a second section 15*b* extending laterally from the lower end of the first section. Each second section has a distal end portion E. The second sections of the slots in row I extend towards the slots in row II and vice versa, so that the distal end portions E of the slots in both rows are disposed in longitudinal, or vertical, alignment along the longitudinal centerline of the intermediate section 13, see FIG. 3. In the illustrated embodiment of the support member 11, each slot distal end portion E includes a slight depression D, the function of which will be described more fully hereinafter.

Each support member is preferably formed of channel stock of suitable metal, (e.g., 16 gauge steel) or plastic material. The support members may be attractively colored and may vary in height, as desired. In mounting the support members in place on a floor or on a vertical wall surface, it is important that the corresponding slots in row I of the mounted support members be disposed in a horizontal plane $H_1$, and in a like manner the corresponding slots in row II be disposed in a second horizontal plane $H_2$, see FIG. 3.

The improved display stand assembly 10 also includes a plurality of product-support units 16 which, as shown in FIGS. 1 and 2, may be in the form of shelves on which products are laid. As an alternative, the units may be in the form of projecting rods, not shown, on which products are hung. The shape, size and number of units mounted on the support members may vary over a wide range.

In the illustrated embodiment, the product-support units 16 are of a skeletal shape and formed of a suitable plastic coated wire. Each unit 16 includes a plurality of first wire segments 17 which project outwardly from the stationary support members and are arranged in parallel, horizontally spaced relation. Each segment has a depending offset inner end portion 17*a*, an upwardly extending outer end portion 17*b*, and a straight intermediate portion 17*c* interconnecting the inner and outer end portions. The inner end portions 17*a* of a unit 17 are interconnected by a one or more transverse reinforcing rods 18. The outer end portions 17*b* may be interconnected by a transversely extending strut 20. The strut 20 has an exposed outer surface 20*a* on which price cards and the like may be mounted. In the illustrated units the intermediate portions 17*c* are inclined downwardly a few degrees towards the outer portion. The reinforcing rods 18 span the distance between adjoining support members 11 and have affixed thereto attaching means which in the illustrated embodiment comprise finger-like elements 21. Each such element includes an inner portion 21*a* which projects rearwardly from the rod 18, and an outer portion 21*b* which extends upwardly from the distal end of the inner portion. The portions define a substantially vertical plane. The dimensions of the element inner and outer portions 21*a*, 21*b* relative to the slot sections 15*a*, 15*b* are such that when the element 21 is disposed in registry with the slot upright first section 15*a*, the unit 16 may be manually moved in a horizontal plane relative to the adjacent support member 11 whereby the inner and outer portions 21*a*, 21*b* of the finger-like element will readily pass through the slot to effect either engagement with or disengagement from the support member.

When engagement between the support members and unit is desired, the support member slots in a selected horizontal plane $H_1$ or $H_2$ are aligned with the corresponding finger-like elements of a unit, allowing the unit to be manually pushed or moved horizontally towards the support members until the outer portions 21*b* of the elements 21 are disposed behind the concealed surfaces C of the support members, see FIG. 5. Once the outer portions 21*b* are behind the concealed surfaces C, the unit may be manually shifted horizontally whereby the inner portions 21*a* will simultaneously move along the slot second sections 15*b* until they reach the slot distal ends E. Upon reaching the slot distal ends E, the unit will move downwardly a small amount whereby the element inner portions 21*a* are releasably accommodated in the slight depressions D formed at the slot distal ends. As the element inner portions are moving along the slot second sections 15*b*, the outer portions 21*b* of the finger-like elements 21 will slidably engage the concealed surfaces C of the support members and, thus, prevent disengagement of the unit from the support members. Because of the cantilevered disposition of the unit with respect to the support members, there is a positive force causing the outer portions 21*b* of the finger-like elements to engage the concealed surfaces C.

To disengage the unit from the support members, the aforementioned procedural steps are followed in reverse order. It should be noted in either instance (i.e. engaging or disengaging) the unit does not require tilting up so that the outer portions of the finger-like elements will clear the slot first sections. Thus, the units 16 may be readily positioned independently in relatively close, vertically spaced relation. Furthermore, adjoining product-support units are not disturbed when a selected unit is being mounted on or removed from the support members.

In the illustrated embodiment, the side flanges 12 of each support member 11 serve a dual function: a) they reinforce each support member against bending when the loaded units are mounted thereon; and b) they protect the finger-like elements disposed therebetween from being accidently struck causing the unit to become disengaged.

As seen in FIG. 3, it is preferred that the distal ends E of the slots of one row be equally spaced, vertically from the slot distal ends of the other rows. As aforementioned, the shape, size and relation locations of the slots formed in the support members may be varied from that shown and will depend upon the types of products or articles being displayed, and the location of the display stand assembly within a given area.

I claim:

1. A display stand assembly comprising a substantially stationary support member, and a removable product-support unit mounted for selective vertical adjustment on said support member, said member including an exposed upright surface having a plurality of slots formed therein and arranged in at least a pair of substantially parallel upright rows, the slots in one row being vertically offset with respect to the slots in the other row, each slot in a row having an upright first section and a second section extending laterally from a lower end portion of the first section, each second section having a distal end portion, the distal end portions of the slots in said row being substantially vertically spaced; said product support unit having a first means projecting outwardly from the exposed surface of said upright support member, and an attaching means disposed at and protruding from a peripheral segment of said first means, said attaching means including a finger-like element having a substantially horizontal inner portion affixed to and protruding from said peripheral segment and an upright outer portion spaced from said peripheral segment, said inner and outer portions defining a substantially vertical plane and being dimensioned whereby said portions are passable substantially horizontally through a selected slot only when said portions are in registry with the slot first section, said attaching means being in interlocking engagement with the support member when said portions pass through the slot first section and then are shifted laterally along the slot second section until the attaching means inner portion is disposed in the slot distal end portion and the outer portion slidably engages a concealed surface of the support member.

2. The display stand assembly of claim 1 wherein the support member includes at least one upright flange extending inwardly from a peripheral side edge of the exposed upright surface.

3. The display stand assembly of claim 1 wherein the support member includes a pair of spaced upright flanges extending inwardly from opposite peripheral side edges of the exposed upright surface; the outer portion of the finger-like element of the attaching means being interposed between the upright flanges when the product-support unit is mounted on the support member.

4. The display stand assembly of claim 3 wherein the upright flanges extend inwardly from the peripheral side edges of the exposed upright surface a distance greater than the distance the outer portion of the finger-like element is spaced from the periphery of the first means of the support unit.

5. The display stand assembly of claim 4 wherein the upright flanges are in substantially parallel relation and are disposed substantially perpendicular to the exposed upright surface of the support member.

6. The display stand assembly of claim 1 wherein the second sections of the slots of each row extend laterally toward the slots of the other row.

7. The display stand assembly of claim 6 wherein the second section of each slot extends in a substantially horizontal direction from the lower end portion of the slot first section.

8. The display stand assembly of claim 1 wherein the first section of each slot has a longitudinal dimension and a transverse dimension greater than corresponding dimensions of the outer portion of the finger-like element; the second section of each slot has a lateral dimension substantially greater than a width dimension of the finger-like element inner portion; a second dimension of said slot second section measured substantially perpendicular to the lateral dimension thereof being substantially equal to but greater than a dimension of the inner portion taken substantially perpendicular to the width dimension thereof.

9. The display stand assembly of claim 1 wherein the distal end portion of each slot second section is provided with means for releasably restraining lateral shifting of the finger-like element inner portion from the slot distal end portion towards the lower end portion of the slot first section.

10. A display stand assembly comprising a pair of upright substantially stationary support members arranged in spaced substantially parallel relation, and a plurality of removable product-supporting units mounted in vertically spaced relation on said support members, each unit being independently selectively adjustable on said support members; each support member being provided with an upright exposed surface having a plurality of slots formed therein and arranged in a pair of spaced substantially parallel rows, one row of slots being vertically offset relative to the other row of slots, each slot having an elongate upright first section and a second section extending laterally from a lower end of the first section, each second section having a distal end portion, the distal end portions of the slots in a row being in substantially vertical alignment; each product-support unit having a first segment spanning the distance between said support members and projecting outwardly therefrom, and a pair of attaching finger-like elements, one for each support member, affixed to and extending rearwardly from a peripheral portion of the unit first segment, each element including an inner portion projecting rearwardly from the unit peripheral portion, and an outer portion extending upwardly from the inner portion and spaced rearwardly from the unit peripheral portion; said unit being mounted on said support members when the outer portion of each finger-like element is in registry with the first section of a corresponding support member whereupon said finger-like elements are simultaneously moved in a substantially horizontal direction through the slot first sections until said element outer portions are disposed adjacent concealed surfaces of the support members allowing the finger-like elements to be simultaneously shifted laterally along the slot second sections to the distal end portions thereof; each distal end portion being provided with means for releasably restraining relative shifting movement of the finger-like element when disposed at said distal end portion.

11. The display stand assembly of claim 9 or 10 wherein the restraining means at the distal end portion of the slot second section includes a depression sized to accommodate the inner portion of an accommodated finger-like element.

* * * * *